US005765234A

United States Patent [19]

Petzl et al.

[11] Patent Number: 5,765,234

[45] Date of Patent: Jun. 16, 1998

[54] PROTECTIVE HELMET WITH POSITIONING KNOBS ADJUSTABLE TO THE HEAD SIZE

[75] Inventors: Paul Petzl, Barraux; Jean-Marc Hede, Le Touvet, both of France

[73] Assignee: Zedel, Crolles, France

[21] Appl. No.: 826,405

[22] Filed: Mar. 24, 1997

[30] Foreign Application Priority Data

Apr. 2, 1996 [FR] France ..... 96 04374

[51] Int. Cl.[6] ..... A42B 3/04

[52] U.S. Cl. ..... 2/417

[58] Field of Search ..... 2/410, 411, 417, 2/418, 419, 420, 425

[56] References Cited

U.S. PATENT DOCUMENTS

| | | | |
|---|---|---|---|
| 631,880 | 8/1899 | Rose | 2/418 |
| 1,163,247 | 12/1915 | McGrew | 2/417 |
| 3,329,968 | 7/1967 | Gordon | 2/418 |
| 3,389,405 | 6/1968 | Fattori . | |
| 3,787,894 | 1/1974 | Goodman, Jr. . | |
| 3,918,098 | 11/1975 | Devaney et al. . | |
| 3,925,821 | 12/1975 | Lewicki . | |
| 4,434,514 | 3/1984 | Sundahl et al. . | |

FOREIGN PATENT DOCUMENTS

| | | | |
|---|---|---|---|
| A-259269 | 3/1988 | European Pat. Off. . | |
| A-558427 | 9/1993 | European Pat. Off. . | |
| 2539010-A1 | 7/1984 | France . | |
| 2553266-A1 | 4/1985 | France . | |
| 3300276 | 7/1984 | Germany | 2/417 |

*Primary Examiner*—Michael A. Neas

*Attorney, Agent, or Firm*—Oliff & Berridge, PLC

[57] ABSTRACT

A protective helmet with a crown made of synthetic material comprises a fixing device with a strap and means for adjusting the head-band size. The wall of the crown is drilled in the direction of the thickness with a plurality of orifices for housing positioning knobs adjustable between a first adjustment position corresponding to a large head-band size, in which said knobs are inserted inside the orifices, and a second adjustment position corresponding to a small head-band size, in which said knobs are salient towards the inside of the crown, each positioning knob having gripping means accessible from outside the crown to press the internal bearing face of the knob directly against the user's head.

13 Claims, 15 Drawing Sheets

PROTECTIVE HELMET WITH POSITIONING KNOBS ADJUSTABLE TO THE HEAD SIZE

BACKGROUND OF THE INVENTION

The invention relates to protective helmet with a crown made of synthetic material, comprising a fixing device with a strap and means for adjusting the size of the head-band.

The document EP-A-558,427 describes a safety helmet having an internal lining with a flexible strip arranged laid back from the edge of the crown. The means for adjusting the length of the head-band circumference comprise a cog-wheel mechanism cooperating with a crown-wheel system. The presence of the adjustable lining inside the crown complicates manufacture of the helmet.

SUMMARY OF THE INVENTION

The object of the invention is to achieve a protective helmet having a simple adjustment device to adjust its head-band size to the size of the user's head.

The helmet according to the invention is characterized in that the wall of the crown is drilled in the direction of the thickness with a plurality of orifices for housing positioning knobs adjustable between a first adjustment position corresponding to a large head-band size, in which said knobs are inserted inside the orifices, and a second adjustment position corresponding to a small head-band size, in which said knobs are salient towards the inside of the crown, each positioning knob having gripping means accessible from outside the crown to press the internal bearing face of the knob directly against the user's head.

Adjustment of the positioning knobs can be performed by sliding or turning each button inside the corresponding orifice.

According to a preferred embodiment, each positioning knob is mounted with rotation inside the corresponding circular orifice and cooperates with a screw-nut system to achieve limited translational movement of said internal bearing face during said adjustment of the head-band.

The positioning knob advantageously comprises a rotary operating ring equipped with a first threading, which cooperates with a second threading securedly united to a cylindrical insert fixed coaxially in the corresponding orifice by means of securing parts.

According to one feature of the invention, the first threading of the operating ring comprises a plurality of notches staggered at regular intervals along the circumference of the threads and cooperating with a teat of the second threading to constitute a stable adjustment in an intermediate position situated between the first and second adjustment positions.

Fitting of each positioning knob in the corresponding orifice is achieved by clipping the operating ring onto the insert by means of the cooperation of flexible retaining tabs on the teeth of the second threading so as to constitute a captive assembly.

The crown can be made of light plastic material, for example polystyrene foam.

BRIEF DESCRIPTION OF THE DRAWINGS

Other advantages and features will become more clearly apparent from the following description of an embodiment of the invention, given as a non-restrictive example only, and represented in the accompanying drawings, in which.

DETAILED DESCRIPTION OF THE PREFERRED EMBODIMENT

Figure 1:
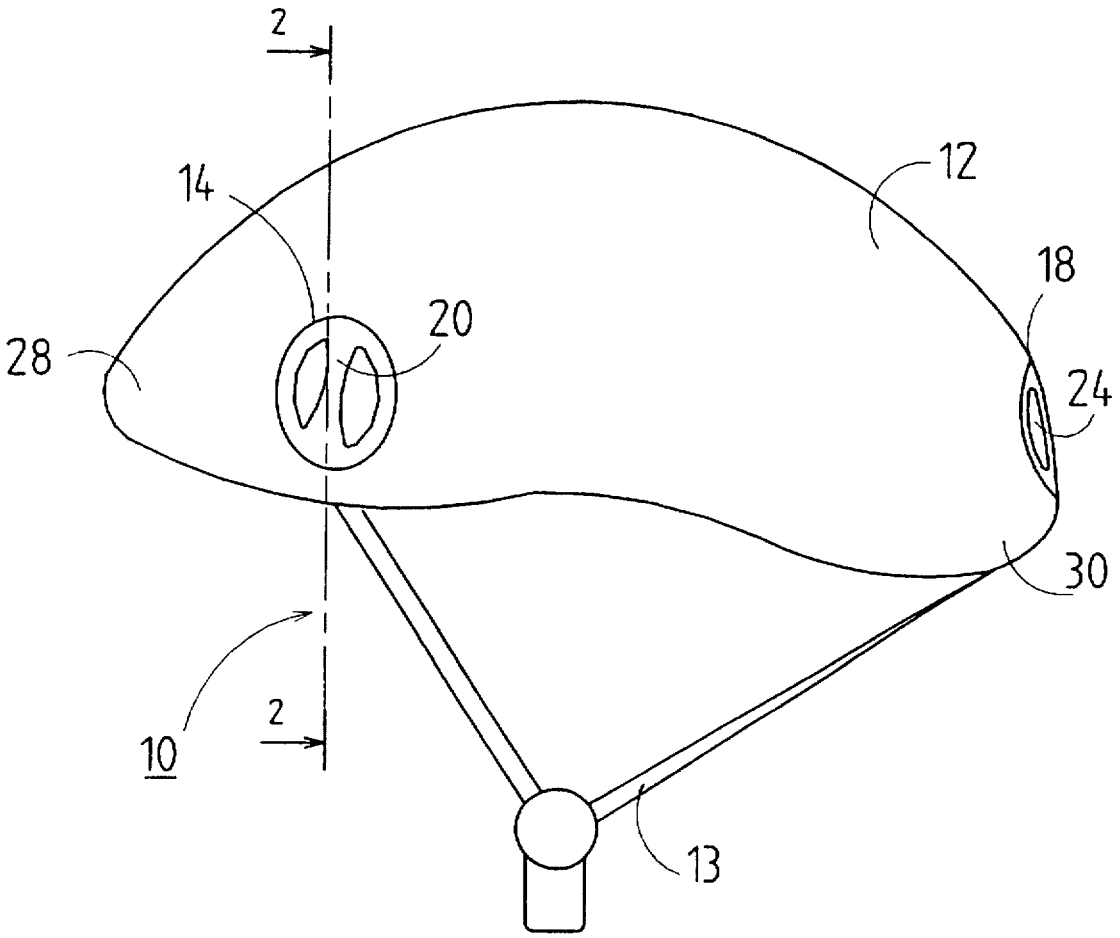
FIG. 1 is a side view of the helmet according to the invention.

With reference to FIGS. 1 to 5, a protective helmet 10 comprises a crown 12 designed to envelop the upper part of the user's head, and a fixing device 13 with a strap for securing around the chin. The wall of the crown 12 is drilled transversely in the direction of the thickness with a series of orifices 14, 16, 18 for housing positioning knobs 20, 22, 24 with radial movement according to the head-band size. Centering of the head 11 inside the crown 12 is advantageously achieved by adjustment of three positioning knobs. Two knobs 20, 22 are located in the opposite side faces of the front part arranged between the mid-plane axis 26 and the front 28 of the helmet 10. A third knob 18 is located at the rear 30 of the crown 12. It is clear that adjustment of the head-band size can be performed by means of a different number of positioning knobs. The knobs 20, 22, 24 have conjugate shapes to those of the orifices 14, 16, 18.

Figure 2:
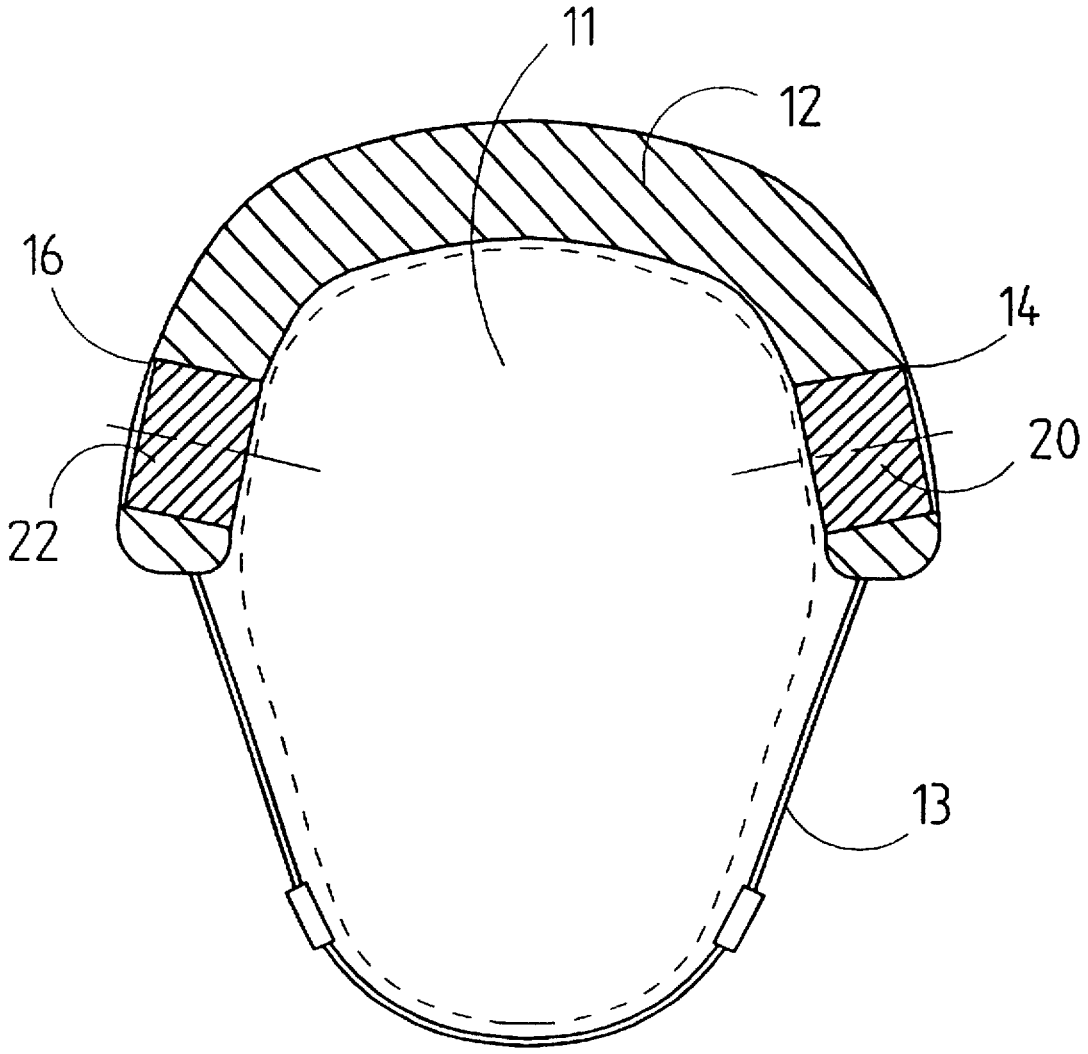
FIGS. 2 and 3 are cross-sectional views along the line 2—2 of FIG. 1, respectively in the first adjustment position corresponding to a large head-band size and a second adjustment position corresponding to a small head-band size.
Figure 4:
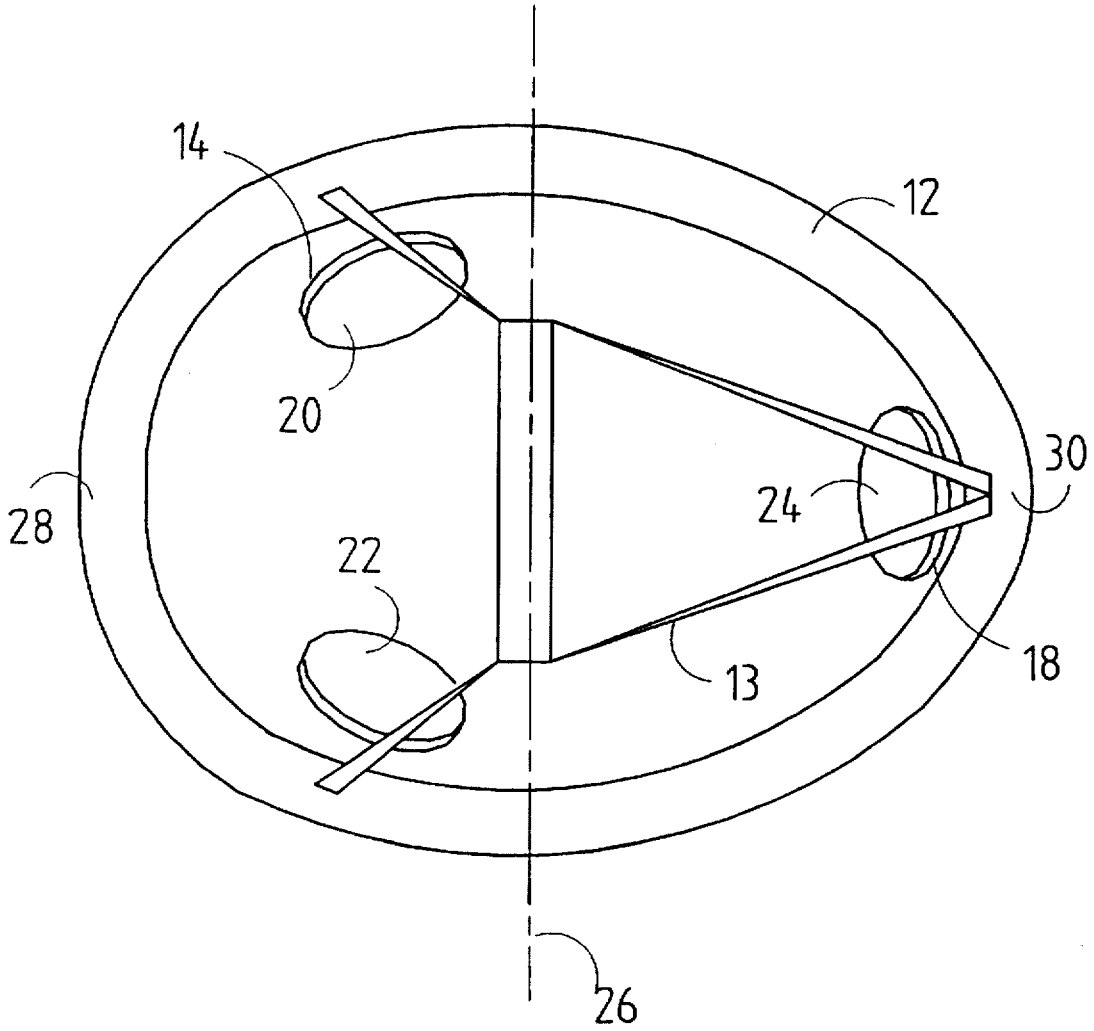
FIGS. 4 and 5 represent bottom views of FIG. 1, respectively in the first adjustment position corresponding to a large head-band size and a second adjustment position corresponding to a small head-band size.

FIGS. 2 and 4 illustrate a first adjustment for a large head-band size (represented by the broken line in FIG. 2), the knobs 20, 22, 24 being fully inserted in the corresponding orifices 14, 16, 18.

Figure 3:
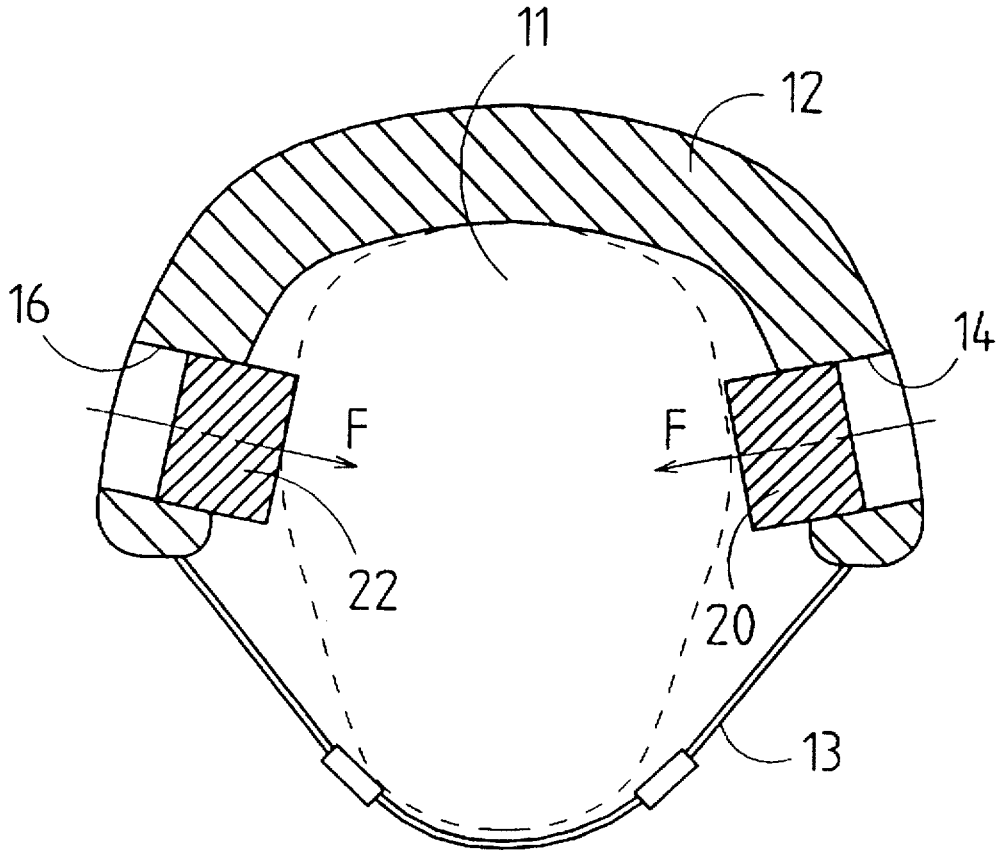
Figure 5:
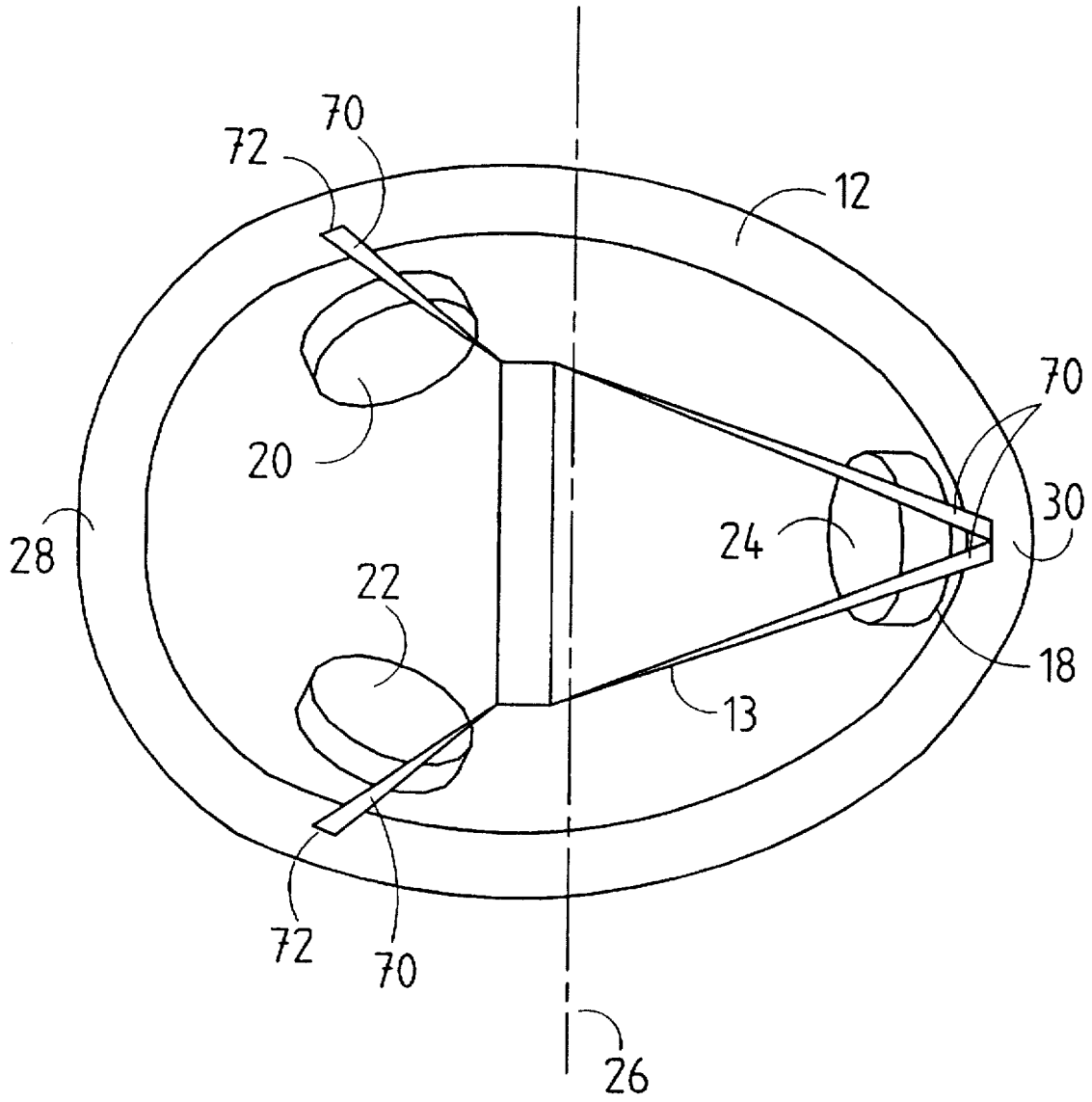

FIGS. 3 and 5 show a second adjustment for a small head-band size (represented by the broken line in FIG. 3), the knobs 20, 22, 24 protruding inwards towards the inside of the crown 12 after a maximum translational movement in the direction of the arrow F (FIG. 3). An intermediate adjustment can naturally be chosen for a medium head-band size, so as to make each knob 20, 22, 24 press against the user's head 11.

In FIG. 5, it can be noted that the rear positioning knob 24 has a greater adjustment travel than that of each of the other two knobs 20, 22 located at the front part.

Adjustment of each positioning knob 20, 22, 24 between the two adjustment positions can be performed in different ways.

A first technique consists in exerting a pushing or pulling action on the gripping means arranged on the external face of the knob. The knob 20, 22, 24 moves in the corresponding orifice 14, 16, 18 like a sliding movable piston and the orifices 14, 16, 18 can be of any shape.

Another technique makes use of rotary positioning knobs 20, 22, 24 cooperating with a screw device able to generate a continuous and precise adjustment travel between the two extreme positions. Four embodiments will be described hereinafter in relation to rotary knobs.

The crown 12 of the helmet 10 is made by molding a light plastic material, notably a polystyrene foam or polyurethane.

Figure 6:
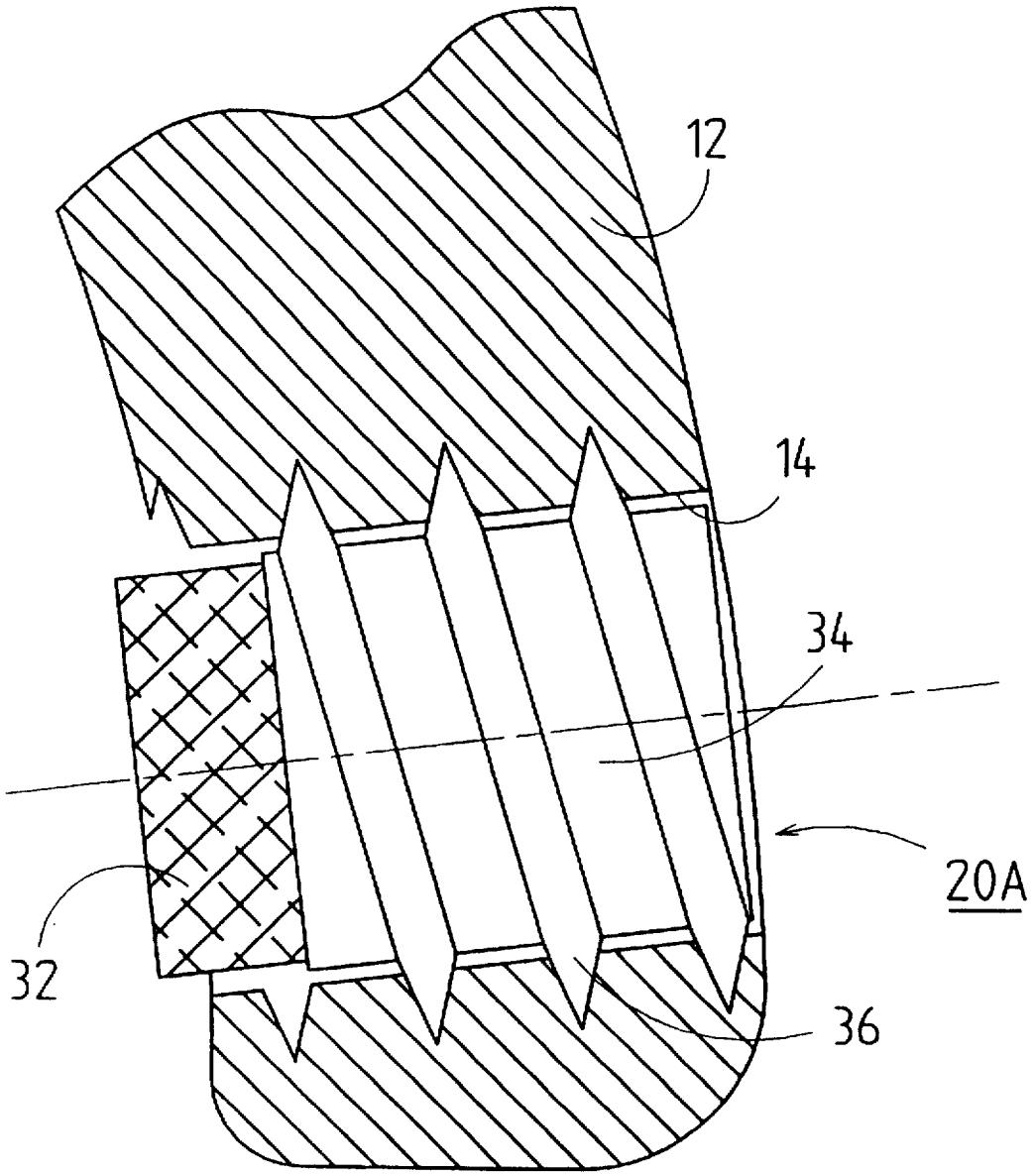
FIG. 6 is a cross-sectional view of a rotary positioning knob.

With reference to FIG. 6, the positioning knob 20A is arranged in a circular orifice 14 passing right through the wall of the crown 12. The knob 20A comprises a uniform chock stud 32 secured to a screw 34 having appreciably the same diameter.

The peripheral threading 36 of the screw 34 is screwed directly into the foam around the orifice 14. The external face of the screw 34 is provided with gripping means to turn the knob 20A, the screw 34 moving jointly with the chock stud 32 during adjustment.

Figure 7:
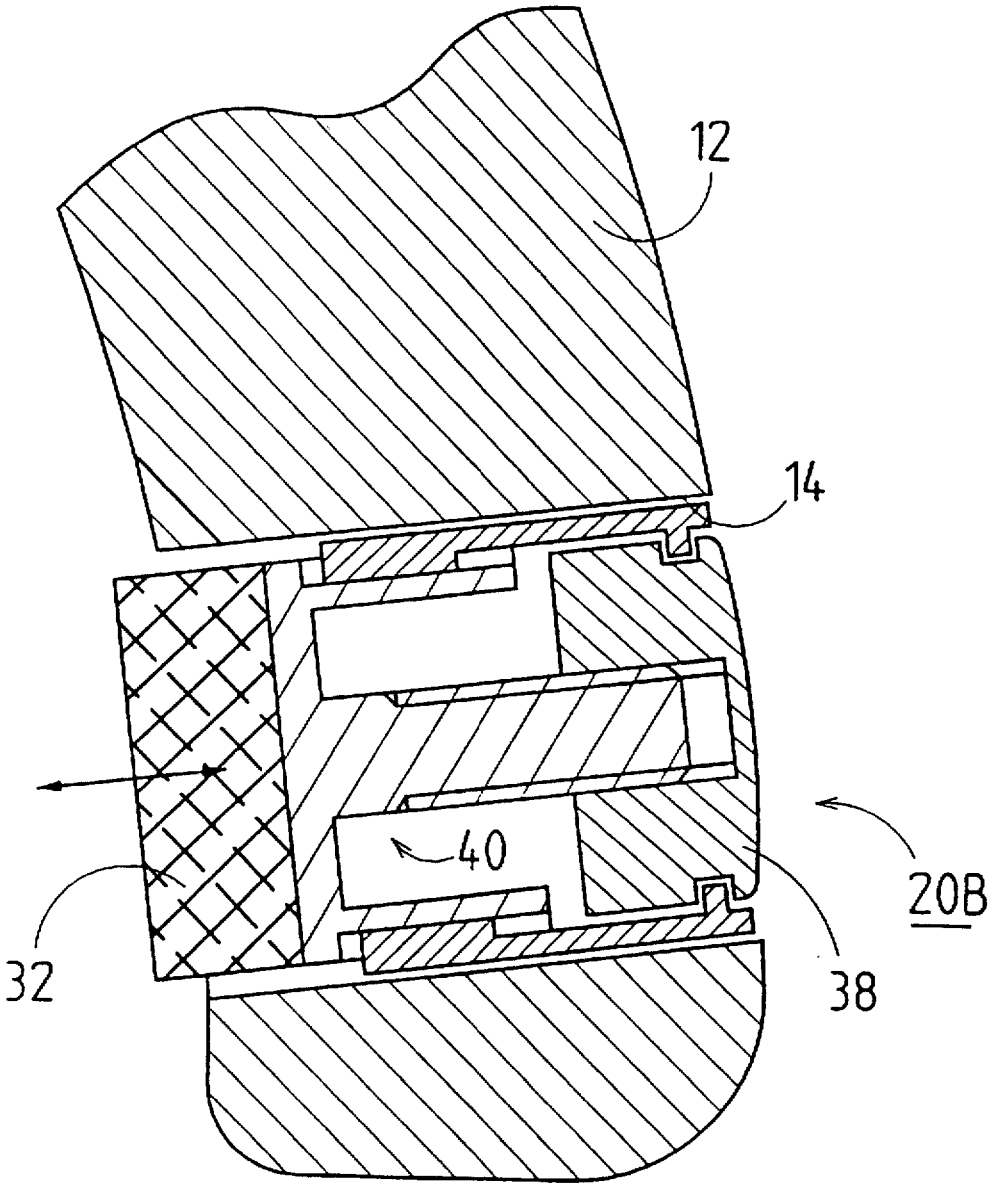
FIG. 7 is an identical view to FIG. 6 of an alternative embodiment.

According to the alternative embodiment of FIG. 7, the positioning knob 20B comprises an external actuating ring 38 designed to drive the internal chock stud 32 by a screw-nut system 40. The ring 38 is mounted with free rotation and its axial position in the orifice 14 remains fixed with respect to the chock stud 32, which moves towards or away from the head 11 according to the direction of actuation exerted on the screw-nut system 40.

Figure 8:
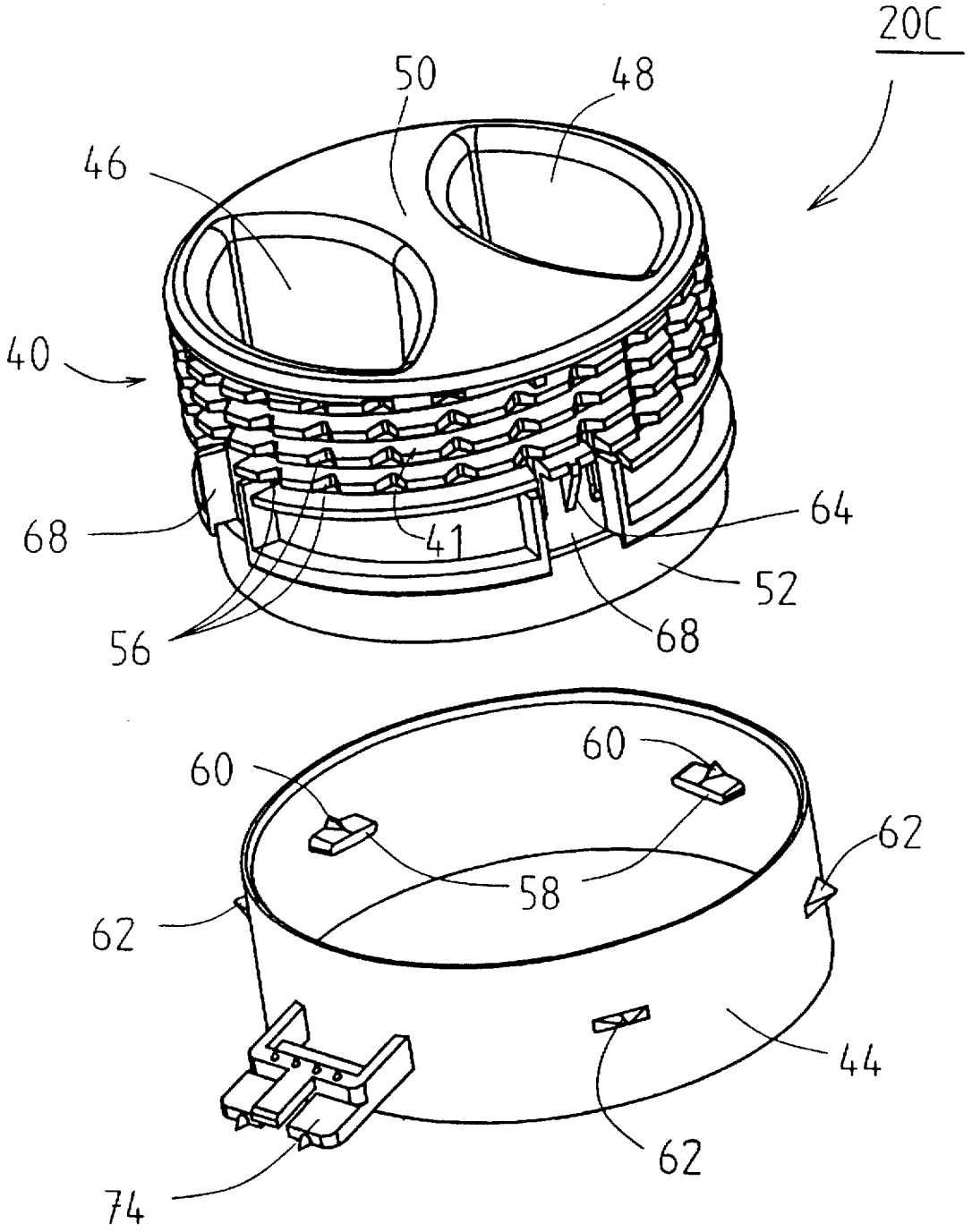
FIG. 8 shows a exploded perspective view of another alternative embodiment of a positioning knob.
Figure 9:
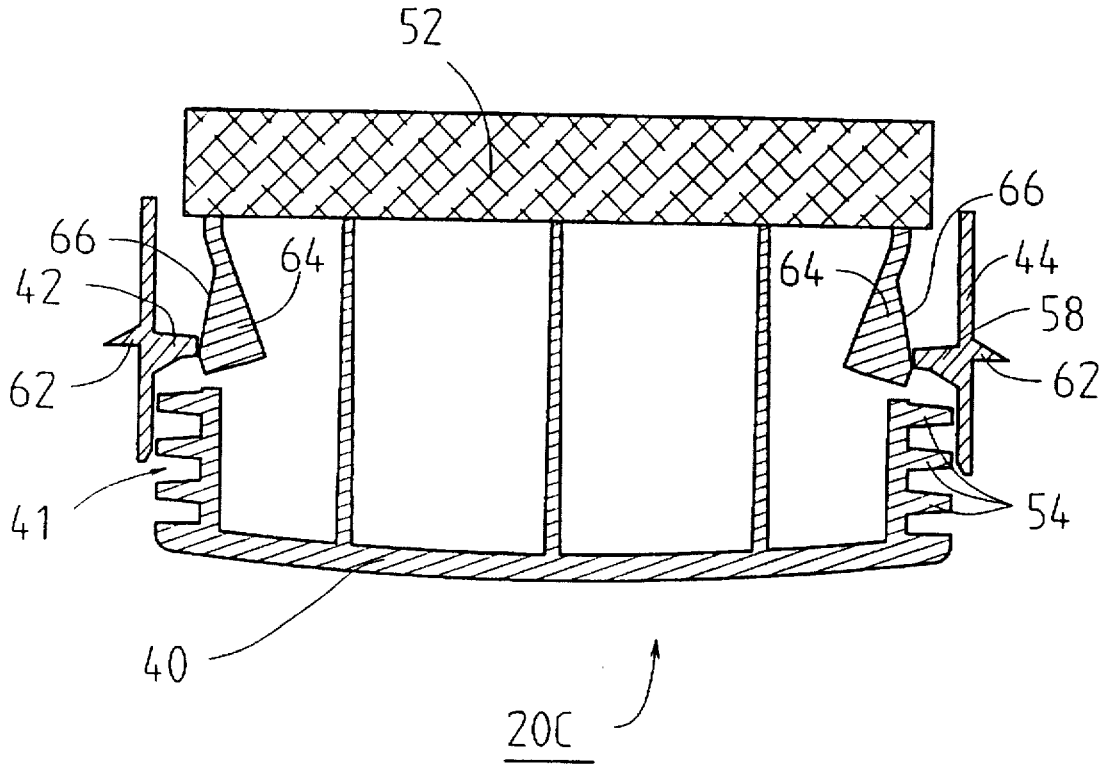
FIG. 9 represents the positioning knob according to FIG. 8 in the course of fitting of the latter on the insert.

With reference to FIGS. 8 and 9, the positioning knob 20C comprises a rotary operating ring 40 equipped with a first threading 41 designed to cooperate with a conjugate second threading 42 of a cylindrical insert 44. The front face of the ring 40 is provided with two ellipsoidal slits 46, 48 separated from one another by a gripping pillar 50 accessible from outside. Secured to the internal face of the operating ring 40 there is a chock stud 52 formed by a foam-based material. The first threading 41 of the ring 40 is provided with four spiral threads 54, each thread 54 having a plurality of notches 56 staggered at regular intervals along the circumference.

The second threading 42 is arranged inside the insert 44 and is formed by four salient teeth 58, two of which can be seen in FIG. 8. The four teeth 58 are diametrically opposite two by two and each comprise a teat 60 designed to engage in a pre-determined notch 56 of the threads 54 when rotation of the ring 40 takes place. The external lateral surface of the cylindrical insert 44 comprises securing barbs 62 designed to penetrate into the polystyrene of the crown 12 when the insert 44 is inserted in the orifice 14.

Clipping the operating ring 40 into the insert 44 is achieved by means of a series of four flexible tabs 64 each having a ramp 66 cooperating with a corresponding tooth 58. At the end of the clipping operation, the ring 40 is fitted captive on the insert 44 and a rotational movement then causes movement of the chock stud in a pre-determined direction.

The clipping tabs 64 extend vertically in recesses 68 of the ring 40, said recesses being situated between the first threading 41 and the chock stud 52. The width of the recesses 68 corresponds appreciably to that of the teeth 58 of the second threading 42.

Figure 10:
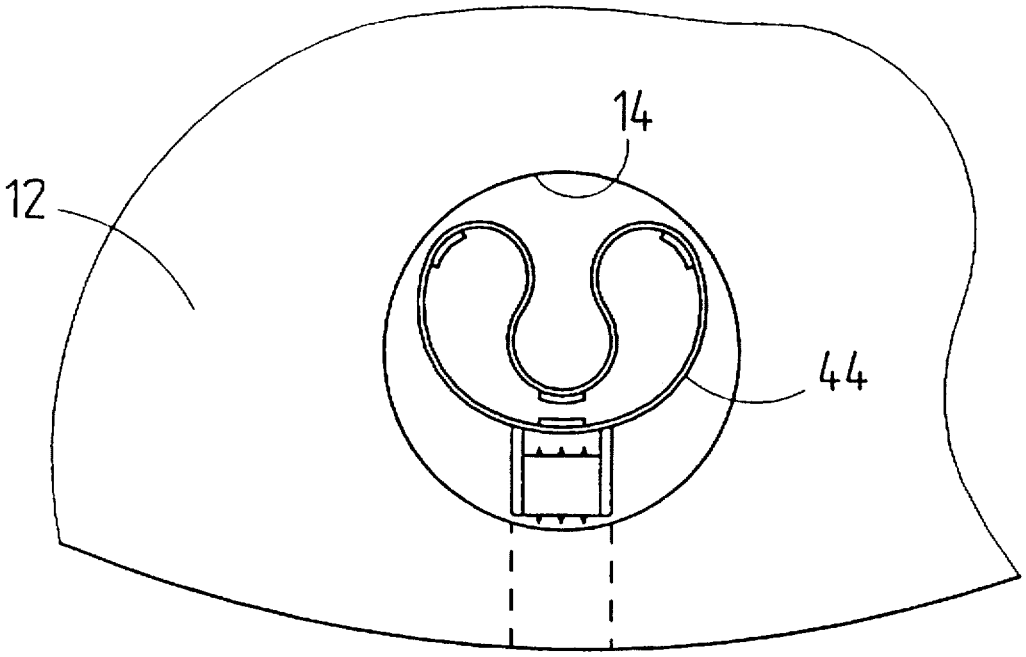
FIG. 10 shows fitting of the insert of FIG. 8 inside the orifice of the crown.

Fitting of the insert 44 in the orifice 14 of the crown 12 is illustrated in FIG. 10. The insert 44 has to be deformed to enable it to be inserted in the orifice 14. From the cylindrical insert of FIG. 8, an inwards pressure with a finger transforms the latter into a crescent shape, whose length is smaller than the diameter of the orifice 14. The thin wall of the insert 44 then simply has to be pushed back in the opposite direction for it to resume its cylindrical shape exactly matching the diameter of the orifice 14, with the securing barbs 62 encrusted in the polystyrene of the crown 12.

Figure 11:
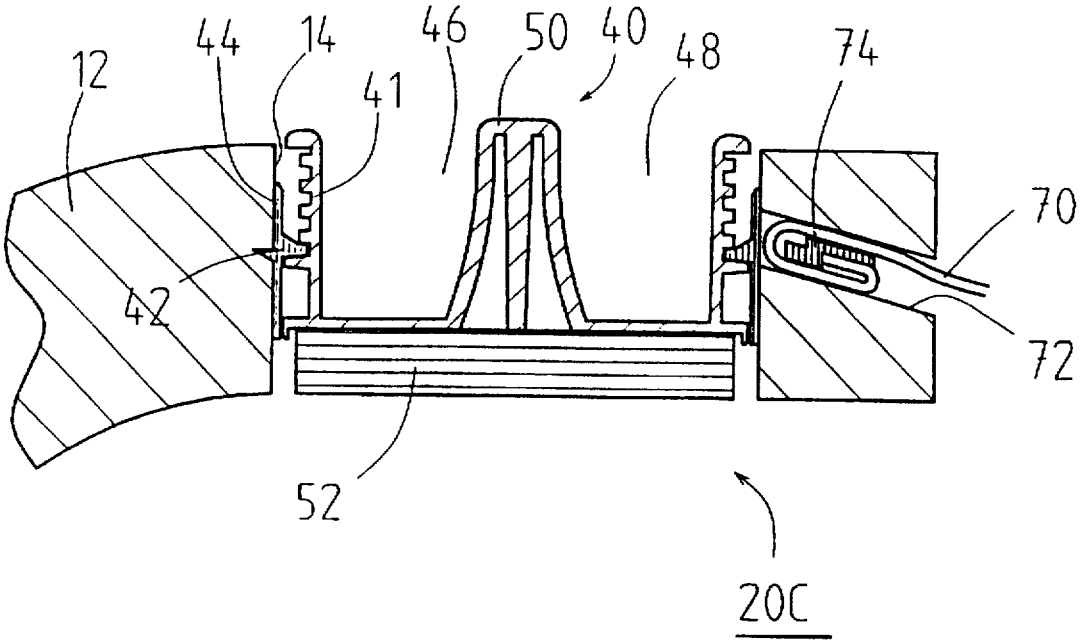
FIGS. 11 and 13 are cross-sectional views of the lateral positioning knob of FIG. 8 inserted in the orifice and represented respectively in the first adjustment position corresponding to a large head-band size and a second adjustment position corresponding to a small head-band size.

FIG. 11 shows the positioning knob 20C fitted in the orifice 14 in the first adjustment position corresponding to a large head-band size. The chock stud 52 is located at the level of the internal wall of the crown 12, and is fully inserted in the orifice 14.

Figure 12:
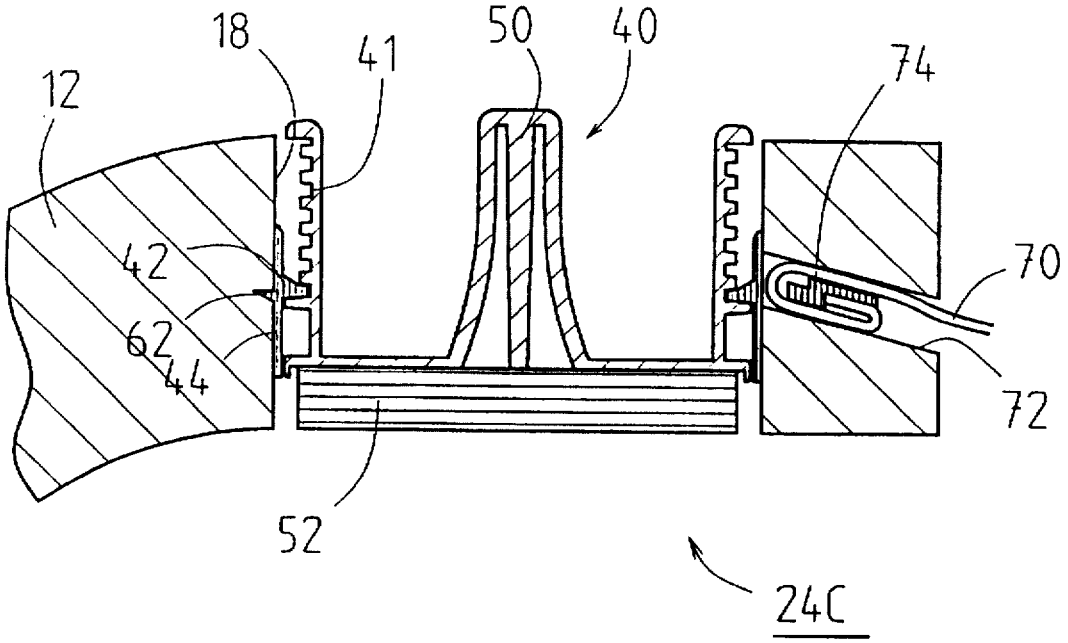
FIGS. 12 and 14 are identical views to FIGS. 11 and 13 for a rear positioning knob.

FIG. 12 shows an identical view to that of FIG. 11 with the rear positioning knob 24C having a long threading 41 enabling the travel of the stud 52 to be increased when the operating ring 40 is turned 40.

Figure 13:
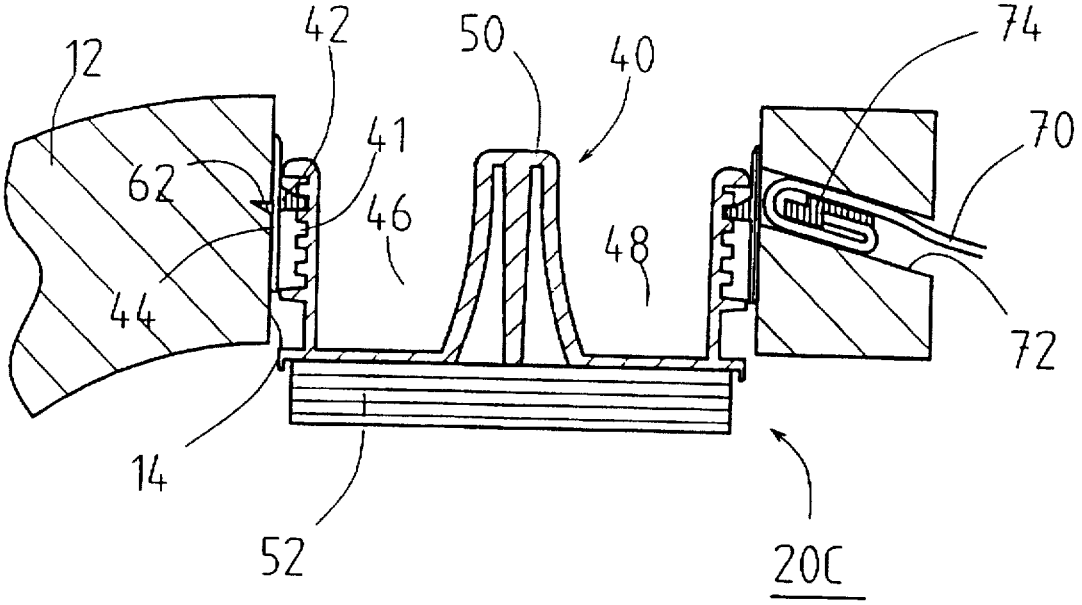
Figure 14:
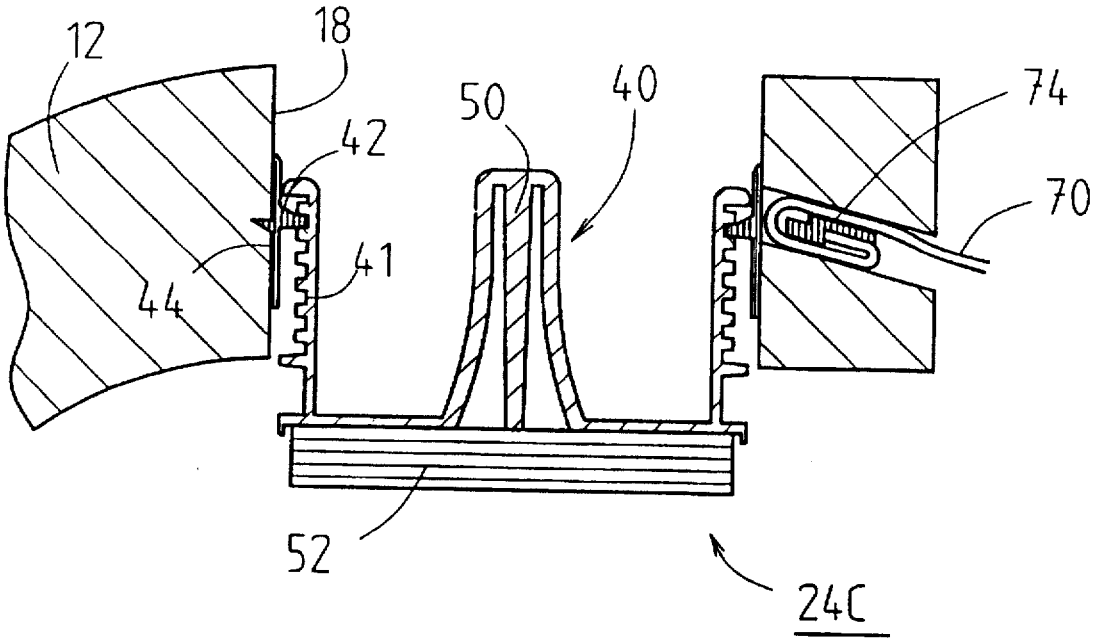

FIGS. 13 and 14 are similar views to those of FIGS. 11 and 12, in the second adjustment position of the knobs 20C, 24C corresponding to a small head-band size. Moving from the first adjustment position to the second adjustment position is achieved after several turns of the operating ring 40, which comprises end-stop means at the opposite ends of the first threading 41. In this second position, the chock studs 52 penetrate inside the crown 12 and are salient with respect to the internal wall of the crown 12.

An intermediate adjustment position for a medium head-band size is perfectly stable due to the engagement of the teats 60 in the notches 56 and threads 54.

The fixing device 13 of the helmet 10 comprises attachment straps 70 (FIG. 5) passing through grooves 72 made in the polystyrene crown 12. The grooves 72 are advantageously located at the level of the inserts 44 of the positioning knobs 20C, 22C, 24C. A securing device 74 of the strap 70 is secured to each insert 44 (see FIG. 8), said strap being located on the same side as the securing barbs 62. The securing device 74 penetrates into the groove 72 when the insert 44 is fitted in the corresponding orifice 14, 16, 18.

Figure 15:
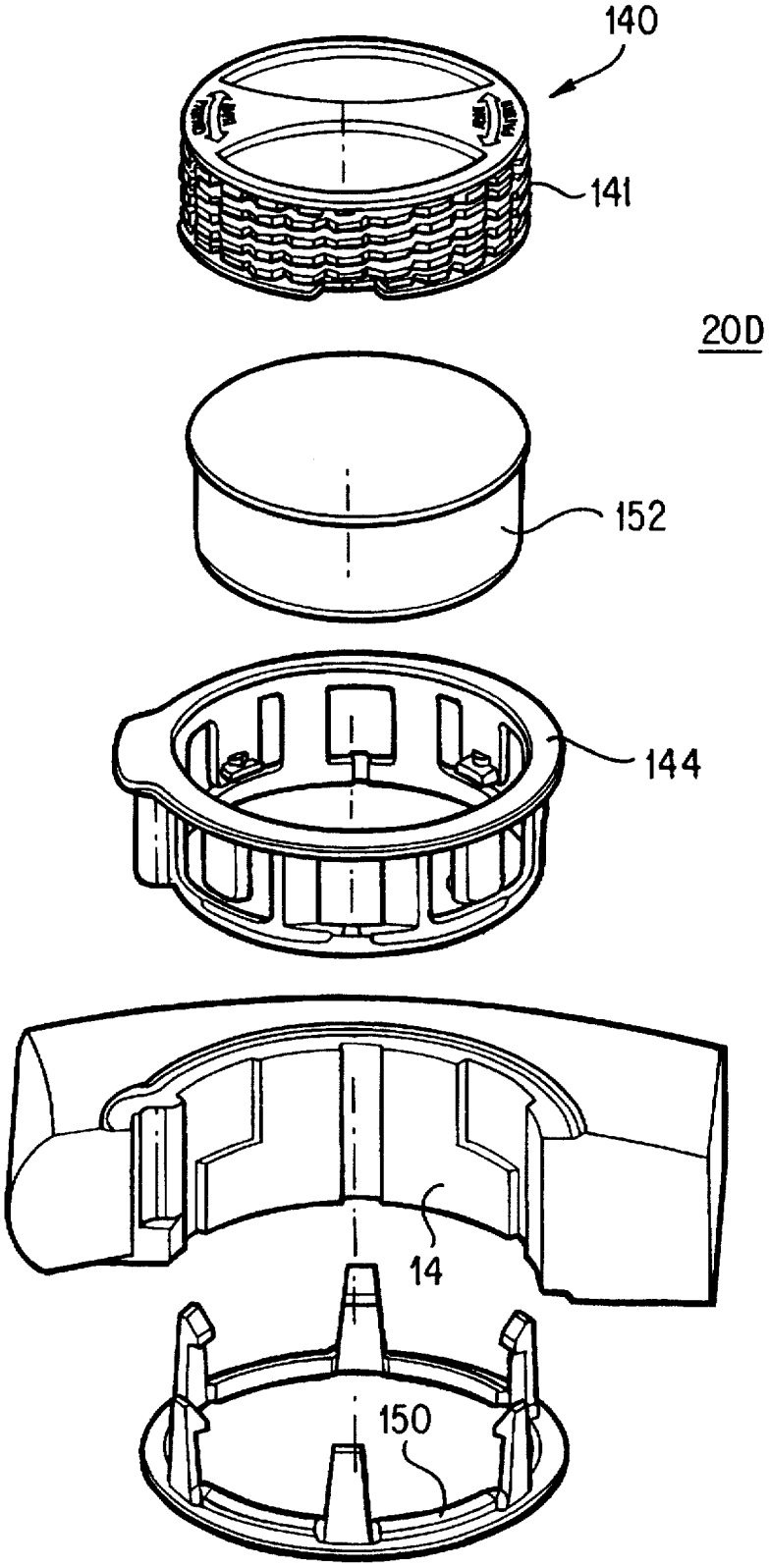
FIG. 15 is an identical view to FIG. 8 representing an exploded perspective view of another alternative embodiment of a rotary positioning knob.
Figure 16:
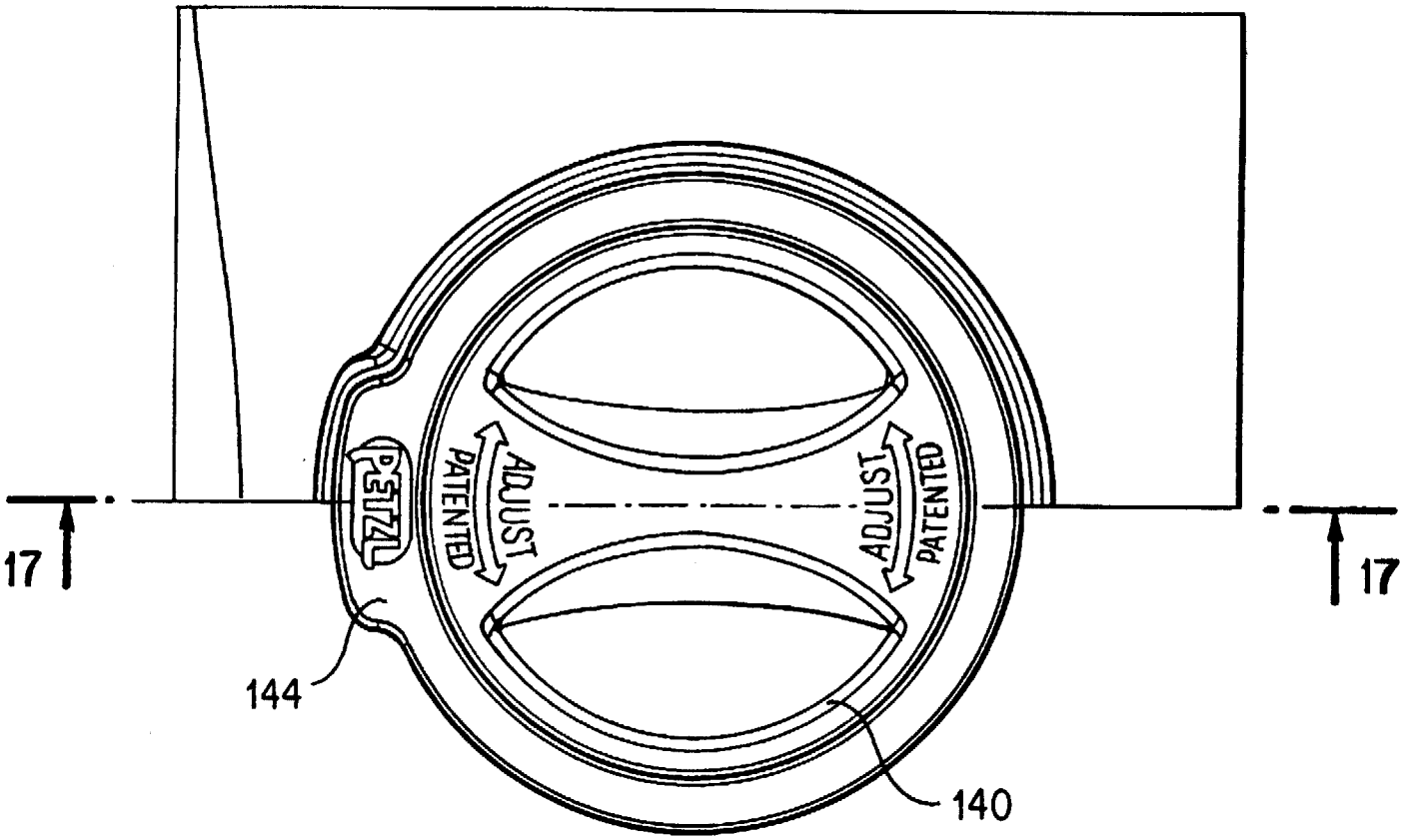
FIG. 16 shows the knob of FIG. 15 fitted in the orifice of the crown and seen from outside.
Figure 17:
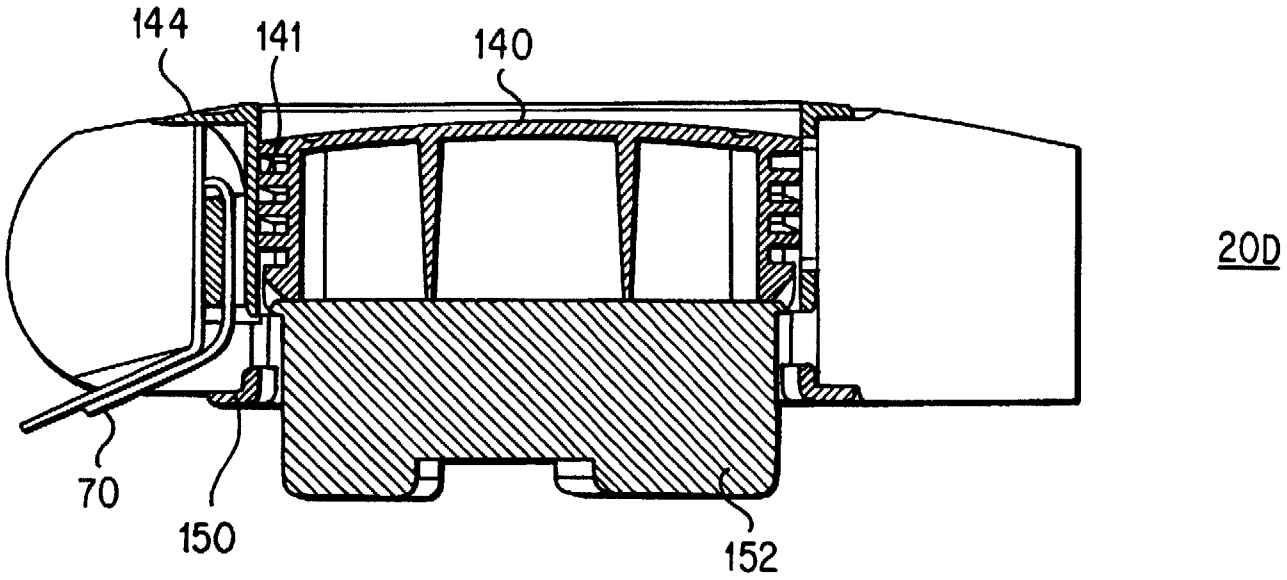
FIG. 17 is a cross-sectional view along the line 17—17 of FIG. 16.

With reference to FIGS. 15 to 17, the positioning knob 20D comprises a rotary operating ring 140 equipped with a first threading 141 and associated to an adjustable chock stud 152. The first threading 141 is identical to the threading 41 of FIG. 8, and cooperates with a second threading 142 arranged inside a cylindrical insert 144 which is made of rigid plastic material.

The knob 20D, chock stud 152, and insert 144 are engaged in the orifice 14 of the crown 12 from the outside of the helmet, the assembly being held in place by means of a locking ring 150, which ring is inserted coaxially in the orifice 14 from the inside of the helmet. The ring 150 advantageously comprises securing lugs 152 designed to block the insert 144 when rotation of the operating ring 140 takes place.

We claim:

1. A protective helmet that can accommodate users having different head-band sizes comprising:

a crown having an outer surface, an inner surface, and a plurality of orifices extending in a transverse direction between the outer surface and the inner surface; and a plurality of positioning knobs, each positioning knob being insertable in one of the plurality of orifices and having an inner end and an outer end, the outer end being accessible from outside the crown to move the inner end into contact with the user's head, wherein said positioning knobs are adjustable within the orifices between a first adjustment position corresponding to a large head-band size and a second adjustment position corresponding to a small head-band size, and wherein said outer ends of the positioning knobs do not extend beyond the outer surface of the crown when the positioning knobs are in the large head-band size position.

2. The protective helmet according to claim 1, wherein the crown includes a front face, a rear face, and opposite side faces, and wherein the plurality of positioning knobs includes first and second positioning knobs located in the opposite side faces of the crown between a transverse mid-plane axis and the front face of the crown, and a third positioning knob located in the rear face of the crown.

3. The protective helmet according to claim 1, wherein each positioning knob is shaped as a piston slidable inside the corresponding one of the orifices to adjust the head-band.

4. The protective helmet according to claim 1, further comprising a screw-nut system, wherein each positioning knob is rotatable in the corresponding orifice and cooperates with the screw-nut system to achieve limited translational movement of the inner end during said adjustment of the head-band.

5. The protective helmet according to claim 4, wherein each positioning knob comprises an internal chock stud attached at the inner end and an adjustment screw portion with a peripheral threading that can be screwed directly into the crown.

6. The protective helmet according to claim 4, further comprising an actuating ring mounted to rotate freely, wherein the screw-nut system cooperates with the actuating ring to move the inner end in translation while maintaining the axial position of the actuating ring inside the orifice during adjustment.

7. The protective helmet according to claim 4, wherein the positioning knob comprises a rotary operating ring equipped with a first threading, which cooperates with a second threading of an insert fixed coaxially in the corresponding orifice by securing parts.

8. The protective helmet according to claim 7, wherein the first threading of the operating ring comprises a plurality of notches staggered at regular intervals along the circumference of the threads and cooperating with a teat of the second threading to constitute a stable adjustment in an intermediate position situated between the first and second adjustment positions.

9. The protective helmet according to claim 8, wherein the second threading is arranged inside the insert and is formed by a plurality of teeth, each comprising a teat designed to engage in a predetermined notch when rotation of the ring takes place.

10. The protective helmet of claim 1, further comprising a fixing device with at least one strap.

11. The protective helmet of claim 10, wherein each strap of the fixing device is attached to the crown.

12. The protective helmet of claim 7, further comprising a fixing device with at least one strap.

13. The protective helmet of claim 12, wherein each strap of the fixing device is attached to the insert.

* * * * *